US008448843B2

(12) United States Patent
Bettinger et al.

(10) Patent No.: US 8,448,843 B2
(45) Date of Patent: May 28, 2013

(54) TWO-PIECE CONTAINER ASSEMBLY AND METHODS OF MAKING THE SAME

(75) Inventors: Charles E. Bettinger, Aledo, TX (US); Allen Keller, Avondale, AZ (US); Kerry Wall, Grapevine, TX (US)

(73) Assignee: Packaging Corporation of America, Lake Forest, IL (US)

( * ) Notice: Subject to any disclaimer, the term of this patent is extended or adjusted under 35 U.S.C. 154(b) by 804 days.

(21) Appl. No.: 12/497,260

(22) Filed: Jul. 2, 2009

(65) Prior Publication Data

US 2010/0006629 A1 Jan. 14, 2010

Related U.S. Application Data

(60) Provisional application No. 61/079,019, filed on Jul. 8, 2008.

(51) Int. Cl.
*B65D 5/36* (2006.01)

(52) U.S. Cl.
CPC ..... *B65D 5/36* (2013.01)
USPC .. 229/125.19; 229/5.5; 229/109; 229/117.01; 229/120.26; 229/122.3

(58) Field of Classification Search
CPC ..... B65D 5/36; B65D 5/3614; B65D 5/3621; B65D 5/3628
USPC ..... 229/5.5, 109, 117.01, 117.05, 117.06, 229/120.24, 120.26, 120.36, 122.27, 122.3, 229/122.33, 125.19, 125.33, 942; 206/386, 206/600
See application file for complete search history.

(56) References Cited

U.S. PATENT DOCUMENTS

| | | | | | |
|---|---|---|---|---|---|
| 371,159 | A | * | 10/1887 | Wright, Jr. | 229/120.36 |
| 1,156,250 | A | * | 10/1915 | Scott | 229/117.05 |
| 1,430,149 | A | | 9/1922 | Bliss | |
| 2,440,193 | A | | 4/1948 | Davis et al. | |
| 2,745,591 | A | | 5/1956 | Holt, Jr. | |
| 2,761,609 | A | * | 9/1956 | Arkin | 229/117.05 |
| 2,766,923 | A | | 10/1956 | D'Esposito | |
| 3,251,533 | A | * | 5/1966 | Cohen | 229/117.05 |
| 3,465,944 | A | | 9/1969 | Robinson | |
| 3,524,578 | A | * | 8/1970 | Benezra | 229/122.3 |
| 3,832,827 | A | | 9/1974 | Lemelson | |
| 3,863,831 | A | * | 2/1975 | Wozniacki et al. | 229/122.26 |
| 3,907,194 | A | | 9/1975 | Davenport et al. | |
| 4,042,164 | A | | 8/1977 | Croley | |
| 4,160,519 | A | | 7/1979 | Gorham | |
| 4,366,021 | A | | 12/1982 | van der Wal | |
| 4,409,776 | A | | 10/1983 | Usui | |
| 4,641,488 | A | | 2/1987 | Garr | |
| 4,702,408 | A | | 10/1987 | Powlenko | |
| 4,718,597 | A | | 1/1988 | Bishop | |
| 4,746,011 | A | | 5/1988 | McNair, Jr. et al. | |
| 4,784,271 | A | | 11/1988 | Wosaba, II et al. | |
| 4,830,271 | A | * | 5/1989 | Lau et al. | 229/117.01 |
| 4,905,451 | A | | 3/1990 | Jaconelli et al. | |
| 5,025,608 | A | | 6/1991 | Marchetti | |
| 5,027,581 | A | | 7/1991 | Kovacs | |
| 5,115,965 | A | | 5/1992 | Alepuz | |

(Continued)

*Primary Examiner* — Gary Elkins
(74) *Attorney, Agent, or Firm* — Nixon Peabody LLP

(57) ABSTRACT

A container assembly is disclosed. The container assembly includes a tube portion including a plurality of sides. The container assembly further includes a base portion including a bottom panel and a plurality of flaps extending from the bottom panel. The plurality of flaps overlap a portion of the plurality of sides.

22 Claims, 14 Drawing Sheets

U.S. PATENT DOCUMENTS

| | | | | |
|---|---|---|---|---|
| 5,314,557 | A | 5/1994 | Schwartz et al. | |
| 5,351,849 | A | 10/1994 | Jagenburg et al. | |
| 5,423,163 | A | 6/1995 | Wendt | |
| 5,447,009 | A | 9/1995 | Olesky et al. | |
| 5,768,862 | A | 6/1998 | Mauro | |
| 5,772,108 | A | 6/1998 | Ruggiere, Sr. et al. | |
| 5,921,465 | A * | 7/1999 | Garton | 229/109 |
| 5,941,452 | A * | 8/1999 | Williams et al. | 229/109 |
| 6,095,409 | A | 8/2000 | Tsai | |
| 6,244,502 | B1 | 6/2001 | Hollar et al. | |
| 6,893,528 | B2 | 5/2005 | Middelstadt et al. | |
| 6,945,018 | B2 | 9/2005 | Suolahti | |
| 7,458,502 | B2 * | 12/2008 | Habeger et al. | 229/122.3 |
| 2005/0040063 | A1 * | 2/2005 | Churvis et al. | 206/386 |
| 2007/0257094 | A1 | 11/2007 | Jackson | |

* cited by examiner

TWO-PIECE CONTAINER ASSEMBLY AND METHODS OF MAKING THE SAME

CROSS-REFERENCE TO RELATED APPLICATION

This application claims the benefit of U.S. Provisional Patent Application No. 61/079,019 filed Jul. 8, 2008, which is hereby incorporated by reference in its entirety.

FIELD OF THE INVENTION

The present invention relates generally to containers for retaining and protecting goods during shipment and methods for making such containers. In particular, the present invention relates to a two-piece, tray-formed shipping container assembly.

BACKGROUND OF THE INVENTION

Corrugated fiberboard containers have been used for many years as shipping and storage containers for a large variety of products. Corrugated fiberboard generally refers to a multi-layer sheet material comprised of sheets of liner bonded to central corrugated layers of medium. Single-wall corrugated involves two sheets of liner bonded on alternate sides of one corrugated medium while double-wall corrugated involves three liners bonded alternatively to two corrugated mediums. Corrugated fiberboard containers may vary greatly in size and weight depending on the intended usage of the container.

The distribution of products in large containers is common in a wide variety of industries, ranging from automotive to food. Corrugated semi-bulk containers ("CBCs") are examples of containers common in the meat industry for storing and shipping beef, pork, and other animal products between processing facilities and from those processing facilities to customers. CBCs often require local horizontal zones of additional reinforcement for containment, to prevent container failure and to ensure the products are saleable when they arrive at the end of the distribution process and any auxiliary processes. Reinforcement methods are often used on CBCs and other corrugated containers to increase the performance.

Internal reinforcement of corrugated board may include polymeric straps located between one of the sheets of liner and one of the mediums to further enhance the bulge or tear resistance of the structure, increasing the performance of the overall container. However, even when polymeric straps are included within the corrugated board structure, a weak spot generally occurs at a manufacturing joint, which is an area of overlap of the fiberboard sheet when a container is formed. Because the corrugated board is discontinuous at this joint, the internal reinforcement is also discontinuous, creating a zone of failure at the joint. This weakness is typically overcome by using external reinforcement in conjunction with or in lieu of internal reinforcement.

External reinforcement is most often accomplished by the use of multiple horizontal bands of strapping material. These external reinforcing straps may be placed on the container when it is in a flat semi-assembled orientation before being formed into a typically shaped container ("knocked down") or may be applied after the container has been formed into its final typical shape ("set-up"). Previous reinforcing straps have been made from metallic materials or polymeric materials. The reinforcing straps are formed onto a set-up CBC or around a knocked down CBC in a continuous loop, with the two ends of the strapping material typically attached together using methods common in the industry. Metallic straps may be crimped together, while polymeric straps may be heat welded together.

External reinforcements are often costly and time-consuming to place on container assemblies. The process of adding external reinforcements often requires significant manual labor, and the placement and/or tension levels often vary, depending, for example, on the operator. Although the process may be automated on a conveyor, extensive capital expense and a dedicated manufacturing line are required to do so. Additionally, because the external reinforcements are often polymeric, metallic, or the like, the external reinforcements are more harmful to the environment than a fiberboard container alone.

Furthermore, the bottoms of existing containers are typically comprised of several flaps, each of which extends from a respective side of the container. The flaps are then attached to one another using an adhesive or other suitable means for attachment to form the bottom. The resulting "interrupted" bottom includes holes that allow for the contents of the container—particularly liquid contents—to escape from the container. Additionally, the interrupted bottom is often prone to snagging and/or tearing a plastic liner that may be contained within the container. The interrupted bottom is also prone to being accidentally opened, or "blown-out," thereby releasing the contents of the container.

Thus, it would be desirable to use a container that addresses one or more of the above-described disadvantages.

SUMMARY OF THE INVENTION

According to one embodiment of the present invention, a container assembly is disclosed. The container assembly comprises a tube portion including a plurality of sides. The container assembly further comprises a base portion including a bottom panel and a plurality of flaps extending from the bottom panel. The plurality of flaps overlap a portion of the plurality of sides.

According to one process of the present invention, a method of forming a container assembly is disclosed. The method comprises the act of adhering a first end of a tube portion to a second, opposing end of the tube portion. The tube portion includes a plurality of sides. The method further comprises the act of providing a base portion having a bottom panel. The bottom panel has a plurality of flaps extending therefrom. The method further comprises the act of placing the tube portion over the base portion. The method further comprises the act of folding the plurality of flaps along fold lines. The fold lines separate the plurality of flaps from the bottom panel. The method further comprises the act of attaching each of the plurality of flaps to a respective one of the plurality of sides of the tube portion.

According to another embodiment of the present invention, a container assembly is disclosed. The container assembly comprises a tube portion including a plurality of sides. The container assembly further comprises a base portion including a bottom panel and a plurality of flaps extending from the bottom panel. The plurality of flaps overlap a bottom region of the plurality of sides. The container assembly further comprises at least one insert portion. The at least one insert portion divides an interior of the container into a plurality of compartments.

According to yet another embodiment of the present invention, a stackable container assembly is disclosed. The stackable container assembly comprises a tube portion including a plurality of sides. Each of the plurality of sides has a first end and a second, opposing end. At least one of the plurality of sides has a stacking feature extending from at least one of the first ends. The stacking feature is generally parallel to the at least one of the plurality of sides. The stackable container assembly further comprises a base portion including a bottom panel and a plurality of flaps extending therefrom. The plurality of flaps are separated from the bottom panel by a plurality of fold lines. The base portion further includes at least one aperture positioned along at least one of the plurality of fold lines. The plurality of flaps overlap the second, opposing ends of the plurality of sides. The container assembly is configured to be stacked on a second, similar container assembly by engaging the stacking feature of the container assembly with an aperture on a base portion of the second container assembly to prevent or inhibit lateral movement of the container assembly relative to the second container assembly.

The above summary of the present invention is not intended to represent each embodiment or every aspect of the present invention. This is the purpose of the figures and the detailed description which follow.

BRIEF DESCRIPTION OF THE DRAWINGS

Other advantages of the invention will become apparent upon reading the following detailed description and upon reference to the drawings in which.

Figure 1:
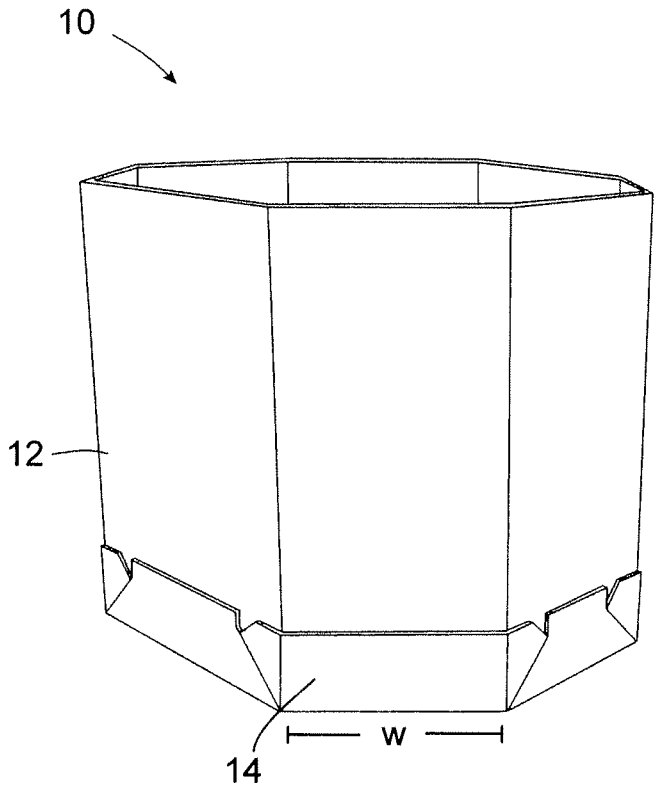
FIG. 1 is an isometric view of a container assembly according to one embodiment of the present invention.

While the invention is susceptible to various modifications and alternative forms, a specific embodiment thereof has been shown by way of example in the drawings and will herein be described in detail. It should be understood, however, that it is not intended to limit the invention to the particular forms disclosed, but, on the contrary, the intention is to cover all modifications, equivalents, and alternatives falling within the spirit and scope of the invention as defined by the appended claims.

DETAILED DESCRIPTION OF THE INVENTION

Turning now to FIG. 1, a container assembly 10 according to one embodiment of the present invention is shown. The container assembly 10 is adapted to hold contents being transported from a first location to a second location. The container assembly 10 has a tube portion 12 and a base portion 14. The tube portion 12 and the base portion 14 may include fiberboard.

In the illustrated embodiment of FIG. 1 the tube portion 12 and the base portion 14 each have an octagonal shape (i.e., eight sides). It is contemplated, however, that the tube portion 12 and the base portion 14 may have any suitable shape such as rectangular, square, hexagonal, other polygonal shapes. It is also contemplated that the width W of the sides may vary.

Figure 2:
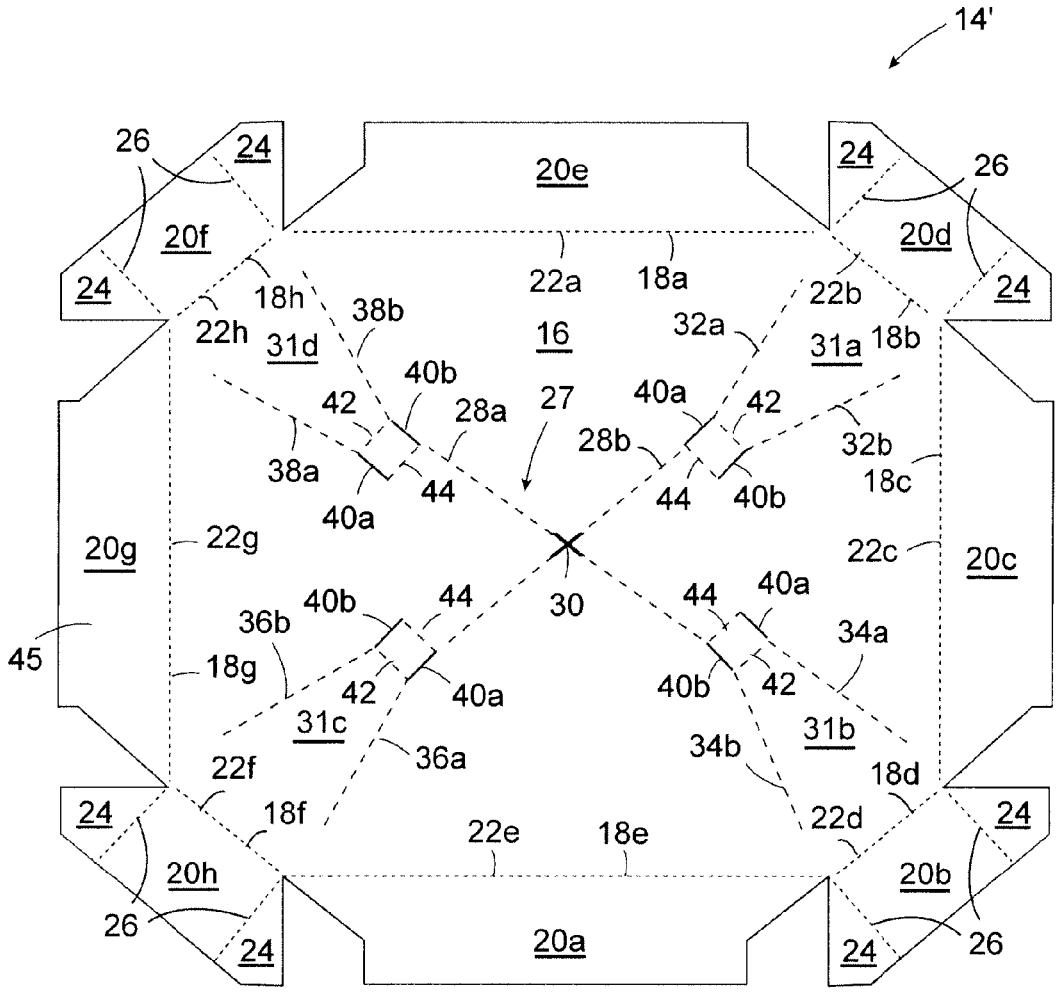
FIG. 2 is a plan view of a base blank for forming a base portion of FIG. 1.
Figure 3:
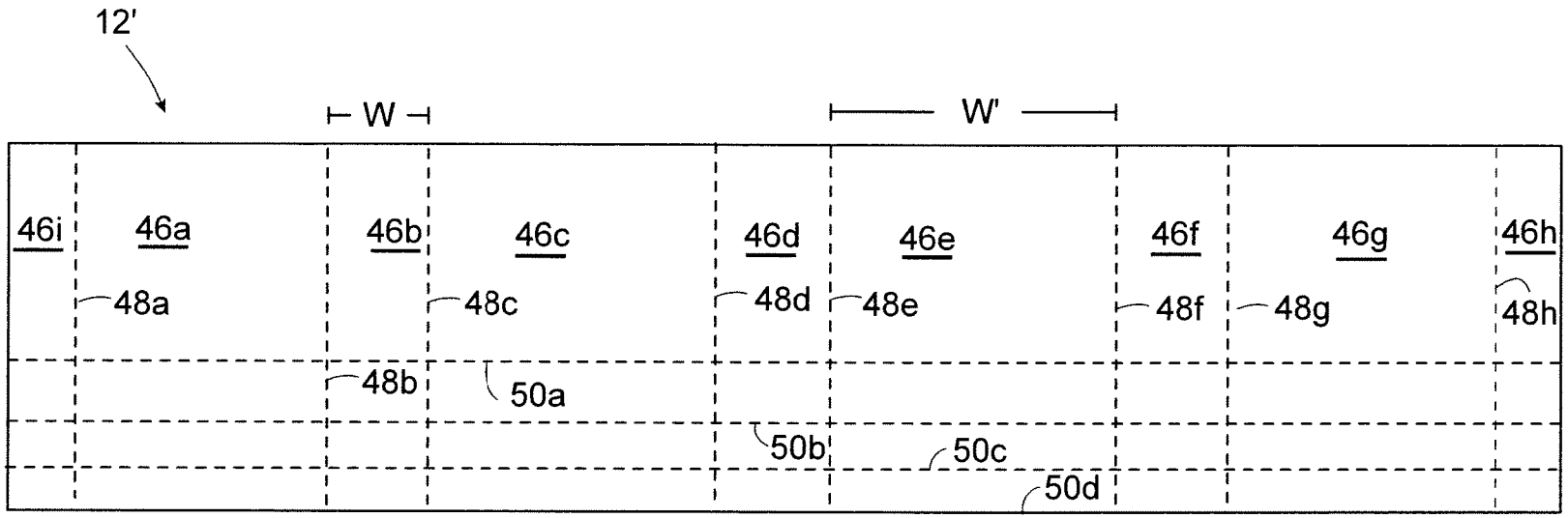
FIG. 3 is a plan view of a tube blank for forming a tube portion of FIG. 1.

Turning now to FIGS. 2, 3 plan views of a base blank 14' and a tube blank 12', respectively, for the formation of the container assembly 10 of FIG. 1 are shown. Referring first to FIG. 2, a top side 45 of the base blank 14' is shown according to one embodiment. The base blank 14' includes a bottom panel 16 having a generally octagonal shape (i.e., eight sides 18*a-h*). The eight sides 18*a-h* include horizontal sides 18*a*, 18*e*, vertical sides 18*c*, 18*g*, and diagonal sides 18*b*, 18*d*, 18*f*, 18*h*. The bottom panel 16 includes eight flaps 20*a-h* extending from and integrated with each of the eight sides 18*a-h*. The flaps 20*a-h* are separated from the bottom panel 16 by respective fold lines 22*a-h*. The flaps 20*b*, 20*d*, 20*f*, 20*h* extending from the generally diagonal sides 18*b*, 18*d*, 18*f*, 18*h* of the bottom panel 16 include opposing tabs 24 extending therefrom. The opposing tabs 24 are separated from the remaining portion of the flaps 20*b*, 20*d*, 20*f*, 20*g* by fold lines 26.

In the embodiment of FIG. 2, the bottom panel 16 further includes a collapsible feature 27 comprising a plurality of perforations and cut-outs. The perforations and cut-outs assist a user in collapsing and disposing of the container assembly 10. In the illustrated embodiment, the bottom panel 16 includes two perforated lines 28*a*, 28*b* that intersect at or near the center of the bottom panel 16. A cut-out "X" 30 is formed at the intersection point of the perforated lines 28*a*, 28*b*. The bottom panel 16 further includes tear-out panels 31*a-d* positioned near the diagonal sides 18*b*, 18*d*, 18*f*, 18*h* of the bottom panel 16. The tear-out panels 31*a-d* are generally bound by a pair of converging perforated lines 32*a,b*, 34*a,b*, 36*a,b*, 38*a,b* generally extending from points near opposing ends of each of the diagonal sides 18*b*, 18*d*, 18*f*, 18*h*. Each of the converging perforated lines 32*a,b*, 34*a,b*, 36*a,b*, 38*a,b* terminates in a cut-out line 40*a*, 40*b*. The cut-out lines 40*a*, 40*b* of each pair of converging perforated lines 32*a,b*, 34*a,b*, 36*a,b*, 38*a,b* are joined by a fold line 42 at one end and by a perforated line 44 at the opposite end.

When a user desires to collapse the container assembly 10 (see FIG. 1), the user may break the perforated lines 44 (e.g., with his or her fingertips), grasp the tear-out panel such that the fold line 42 generally contacts the palm of the user's hand, and pull the tear-out panels 31*a* along the perforated lines 32*a,b*, 34*a,b*, 36*a,b*, 38*a,b*. The user may then push or punch in the center of the bottom panel 16 at the cut-out "X" 30. The bottom panel 16 and, therefore, the container assembly 10, will then be easily collapsed for easy and compact disposal of the container assembly 10.

It is contemplated that a collapsible feature other than the collapsible feature 27 illustrated in FIG. 2 may be incorporated into the base blanks (e.g. base blank 14') of the embodiments of the present invention. It is also contemplated that the base blanks of the embodiments of the present invention may also be solid (i.e., not including a collapsible feature, perforations, or cut-outs).

Referring now to FIG. 3, the tube blank 12' for forming the container assembly 10 is shown according to one embodiment. The tube blank 12' includes nine side panels 46*a-i*. The side panels 46*a-i* are separated by respective fold lines 48*a-h*. The widths W, W' of the side panels 46*a-g* generally correspond with the width W of the sides 18*a-g* of the bottom panel 16 of FIG. 2. The combined width of the endmost side panels 46*h* and 46*i* is slightly greater than the width of the side 18*h* of the bottom panel 16. Thus, when the container assembly 10 (FIG. 1) is assembled, the side panels 46*h*, 46*i* slightly overlap such that they may be readily adhered to one another.

In the embodiment of FIG. 3, the tube blank 12' is made of a single-wall corrugated fiberboard and includes internal reinforcement in the form of a plurality of internal straps 50*a-d* positioned between one of the liner boards and the fluted or corrugated material. The internal straps 50*a-d* may be formed of sesame tape or any other suitable material. It is also contemplated that a different number (i.e., none, one, two, three, or more than four) of internal straps may be used for the tube blank 12'.

The container assembly 10 of FIG. 1 may be assembled using the base blank 14' of FIG. 2 and the tube blank 12' of FIG. 3. To do so, the tube blank 12' may be formed into an octagonal shape such that the endmost side panels 46*h*, 46*i* are aligned and at least partly flush with one another. The endmost side panels 46*h*, 46*i* may then be attached to one another using any suitable means such as adhesive. The resulting tube portion 12 is shown in FIGS. 1 and 4.

Figure 4:
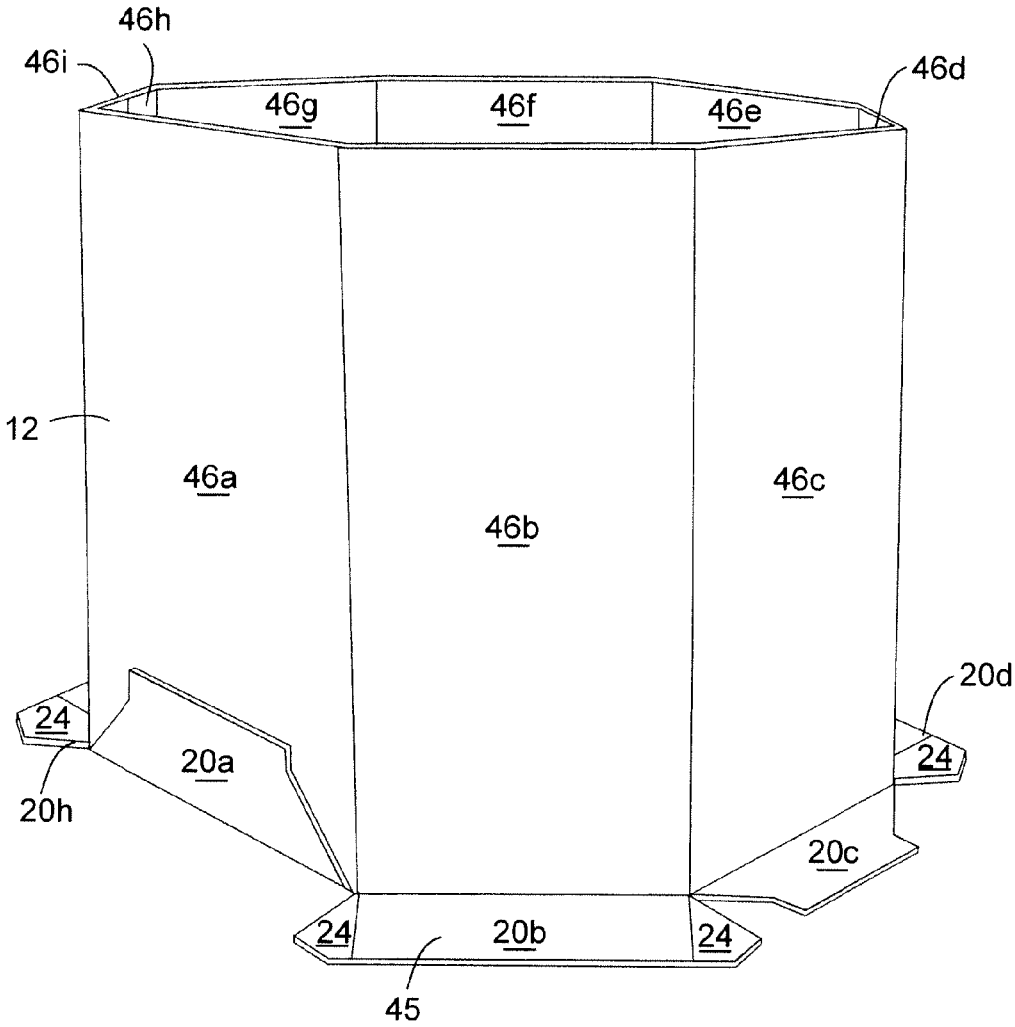
FIG. 4 is an isometric view illustrating the container assembly of FIG. 1 being formed, according to one embodiment.

As shown in FIG. 4, to form the container assembly 10 of FIG. 1, the assembled tube portion 12 is placed over the bottom panel 16 of the base blank 14' (FIG. 2) such that each of the side panels 46*a-g* of the tube portion 12 is adjacent to each of the respective flaps 20*a-g* of the base blank 14'. The overlapping side panels 46*h*, 46*i* are adjacent to the flap 20*h*. In one embodiment, adhesive is placed on the top sides 45 of the flaps 20*a-h* and the tabs 24. Each flap 20*a-h* is then folded toward the tube portion 12 along its respective fold line 20*a-h* such that the adhesive top sides 45 of the flaps 20*a-h* contact and adhere to the respective side panels 46*a-i*. The tabs 24 are then folded along their respective fold lines 26 and adhered to the adjacent side panels 46 of the tube portion 12. As shown in FIG. 4, for example, the tabs 24 of the flap 20*b* are adhered to the side panels 46*a*, 46*c*. In other embodiments, the flaps 20*a-h* are folded prior to placing the tube portion 12 over the base portion 10.

The resulting double thickness reinforces the corners and vertical scores of the container assembly 10. The integrity of the lower portion of the container assembly 10 is, thus, significantly reinforced, thereby improving the overall strength of the container assembly 10.

Figure 5:
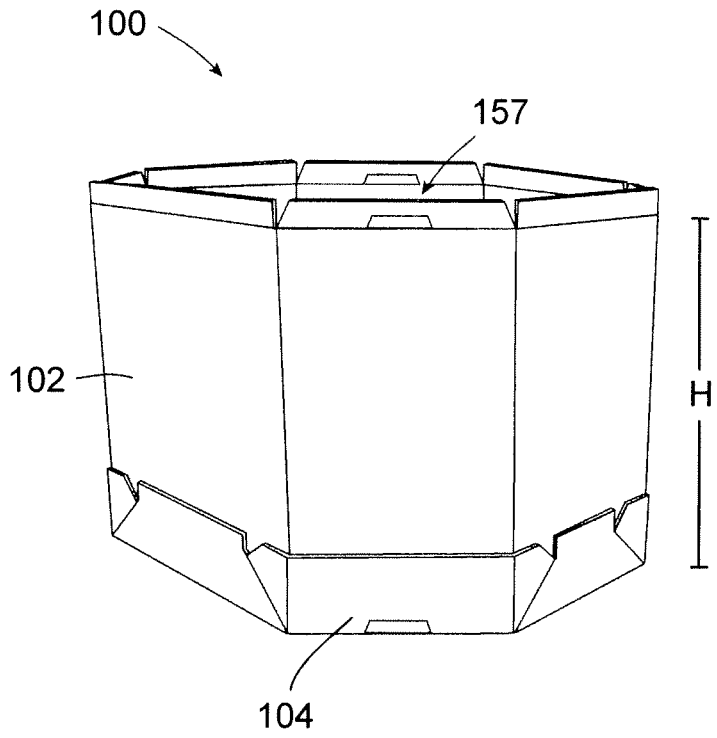
FIG. 5 is an isometric view of a container assembly according to another embodiment of the present invention.

Turning now to FIG. 5, a stackable container assembly 100 according to one embodiment of the present invention is shown. Like the container assembly 10 of FIG. 1, the stackable container assembly 100 has a tube portion 102 and a base portion 104. The tube portion 102 and the base portion 104 may include fiberboard. It is contemplated that the container assembly 100 may have a smaller height H than the container assembly 10 of FIG. 1, which may be desirable so that multiple container assemblies may be more readily stacked on top of one another.

Figure 6:
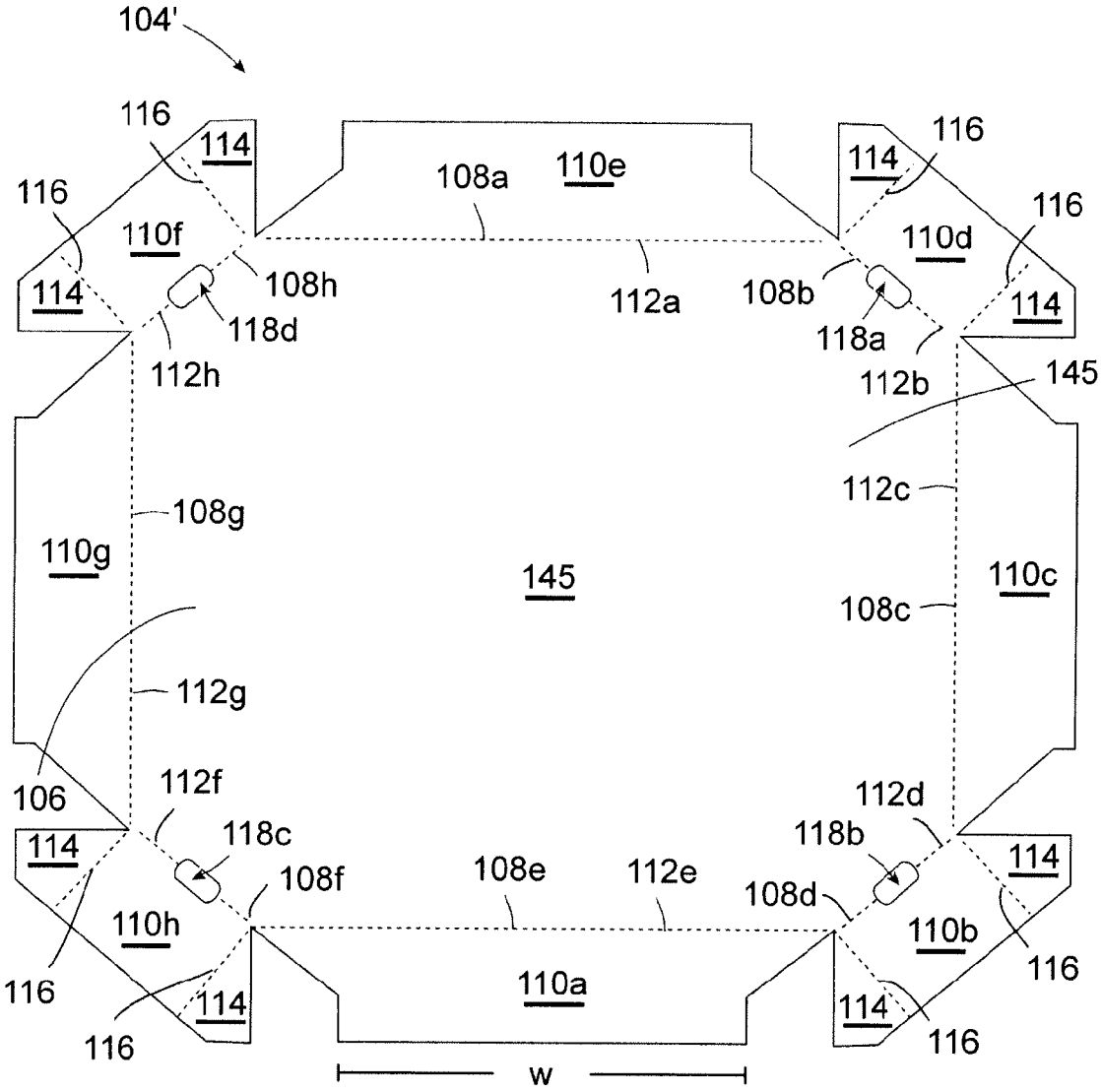
FIG. 6 is a plan view of a base blank for forming a base portion of FIG. 5.
Figure 7:
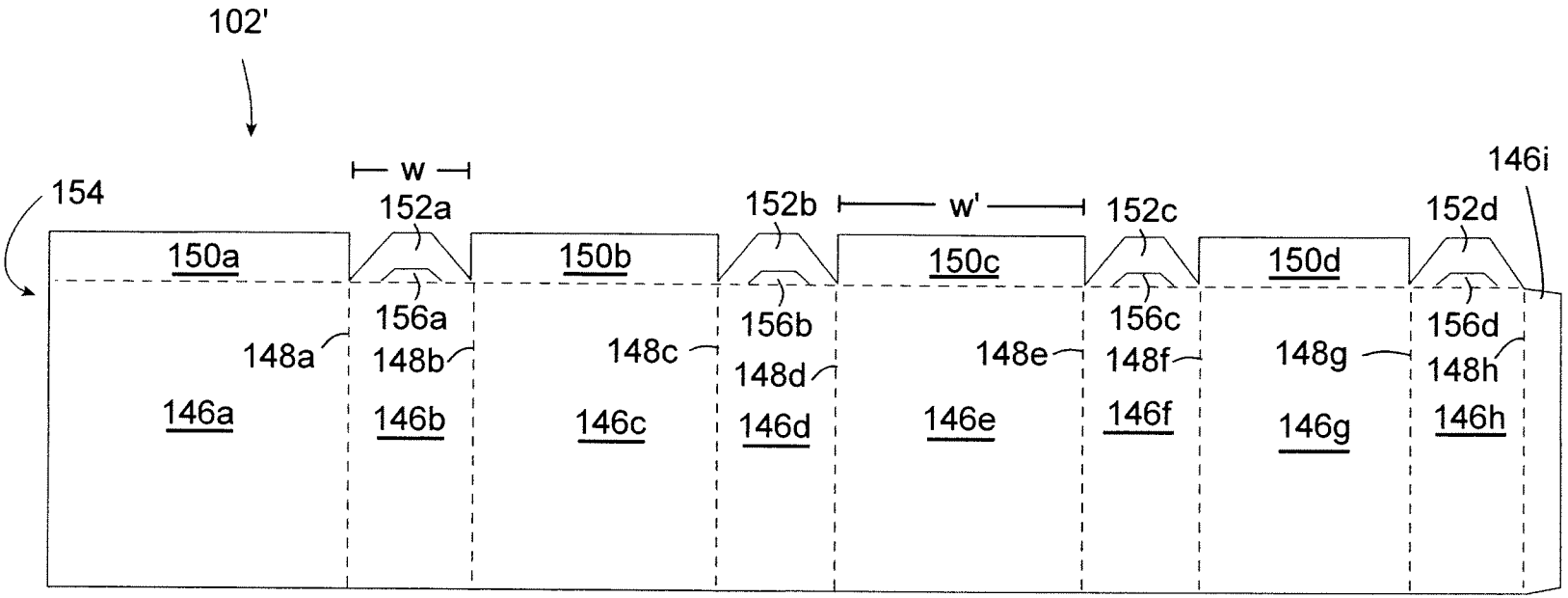
FIG. 7 is a plan view of a tube blank for forming a tube portion of FIG. 5 according to one embodiment.

Turning now to FIGS. 6, 7 plan views of base blank 104' and tube blank 102', respectively, for the formation of the container assembly 100 of FIG. 5 are shown. Referring first to FIG. 6, a top side 145 of the base blank 104' is shown according to one embodiment. The base blank 104' is similar to the base blank 14' of FIG. 2 except that the base blank 104' of FIG. 6 does not include a collapsible feature. Such a smooth, uninterrupted base portion may be desirable to assist in preventing or inhibiting liquid contents from escaping through perforations and/or cut lines on the bottom panel. Additionally, a smooth, uninterrupted bottom is less prone to snagging and/or tearing a plastic liner that may be contained within the container assembly. It is also contemplated that the use of plastic liners in container assemblies having smooth, uninterrupted bottoms may be eliminated altogether. Additionally, a smooth, uninterrupted bottom is also less prone to being accidentally opened, or "blown-out," thereby releasing the contents of the container assembly. It is contemplated, however, that the base blank 104' may also include a collapsible feature including, but not limited to, the collapsible feature 27 of the base blank 14' FIG. 2.

The base blank 104' of FIG. 6 includes a bottom panel 106 having a generally octagonal shape (i.e., eight sides 108*a-h*). The eight sides 108*a-h* include horizontal sides 108*a*, 108*e*, vertical sides 108*c*, 108*g*, and diagonal sides 108*b*, 108*d*, 108*f*, 108*h*. The bottom panel 106 includes eight flaps 110*a-h* extending from and integrated with each of the eight sides 108*a-h*. The flaps 110*a-h* are separated from the bottom panel 106 by fold lines 112*a-h*. The flaps 110*b*, 110*d*, 110*f*, 110*h* extending from the generally diagonal sides 108*b*, 108*d*, 108*f*, 108*h* of the bottom panel 106 and include opposing tabs 114 extending therefrom. The opposing tabs 114 are separated from the flaps 110*b*, 110*d*, 110*f*, 110*h* by fold lines 116.

The base blank 104' further include apertures 118*a-d* generally located along a portion of the fold lines 112*b*, 112*d*, 112*f*, 112*h* adjacent to the diagonal flaps 110*b*, 110*d*, 110*f*, 110*h*. As will be described in more detail below with respect to FIG. 9, the apertures 118*a-d* assist in stacking the container assembly 100 with other, like container assemblies.

Referring now to FIG. 7, the tube blank 102' of the stackable container assembly 100 is shown according to one embodiment. Like the tube blank 12' of FIG. 3, the tube blank 102' of FIG. 7 includes nine side panels 146*a-i*. The side panels 146*a-i* are separated from one another by fold lines 148*a-h*. The widths w, w' of the side panels 416*a-g* generally correspond with the widths w of the sides 108*a-h* of the bottom panel 106 of FIG. 6. When the container assembly 100 (FIG. 5) is assembled, the side panels 146*h*, 146*i* overlap such that they may be readily adhered to one another. Although not necessary, the tube blank 102' may include internal reinforcement in the form of a plurality of internal straps such as the internal straps 50*a-d* of FIG. 3.

The side panels 146*a-h* include alternating flanges 150*a-d* and flaps 152*a-d* extending from the top ends 154 of the side panels 146*a-h*. The flaps 152*a-d* include stacking features 156*a-d*. As will be described in more detail below with respect to FIG. 8, the side-panels 146*a-h* include stacking features 156*a-d* extending therefrom. The stacking features 156*a-d* assist in stacking the container assembly 100 with other, like container assemblies.

The container assembly 100 of FIG. 5 may be assembled using the base blank 104' of FIG. 6 and the tube blank 102' of FIG. 7. To do so, the tube blank 102' may be formed into an octagonal shape such that the endmost side panel 146*a* is aligned with and at least partly overlapping the opposing endmost side panel 146*i*. The endmost side panels 146*a*, 146*i* may then be attached to one another using any suitable means such as adhesive. The resulting tube portion 102 is shown in FIGS. 5 and 8.

Figure 8:
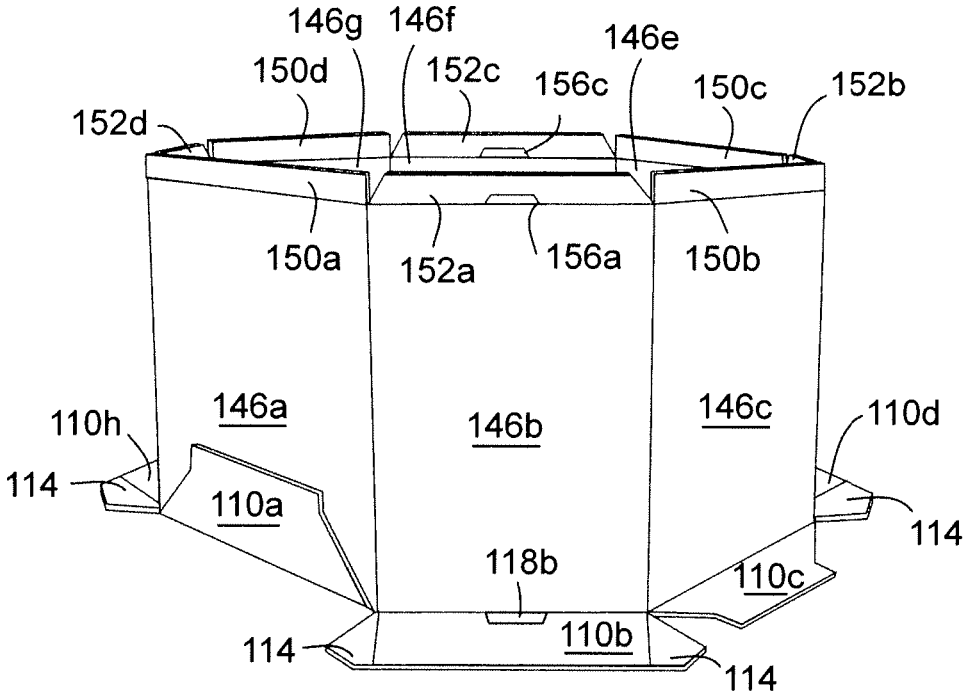
FIG. 8 is an isometric view illustrating the container assembly of FIG. 5 being formed, according to one embodiment.

As shown in FIG. 8, to form the container assembly 100 of FIG. 5, the tube portion 102 is placed over the bottom panel 106 of the base blank 104' (FIG. 6) such that each of the side panels 146*a-h* of the tube portion 102 is adjacent to each of the respective sides 108*a-h* and flaps 110*a-h* of the base blank 104'. The tube portion 102 is also positioned such that the endmost side panel 146*a* and the overlapping side panel 146*i* is adjacent to the flap 110*h*. In one embodiment, adhesive is placed on the top sides 145 of the flaps 110*a-h*. Each flap 110*a-h* is then folded toward the tube portion 102 along its respective fold line 112*a-h* such that the adhesive top sides 145 of the flaps 110*a-h* contact and adhere to the respective side panels 146*a-i*. The tabs 114 are then folded along their respective fold lines 116 and adhered to the adjacent side panels 146 of the tube portion 102. As shown in FIG. 8, for example, the tabs 114 of the flap 110*b* are adhered to the side panels 146*a*, 146*c*. The resulting double thickness reinforces the corners and vertical scores of the container assembly 100. The integrity of the lower portion of the container assembly 100 is, thus, significantly reinforced, thereby improving the overall strength of the container assembly 100.

Figure 9:
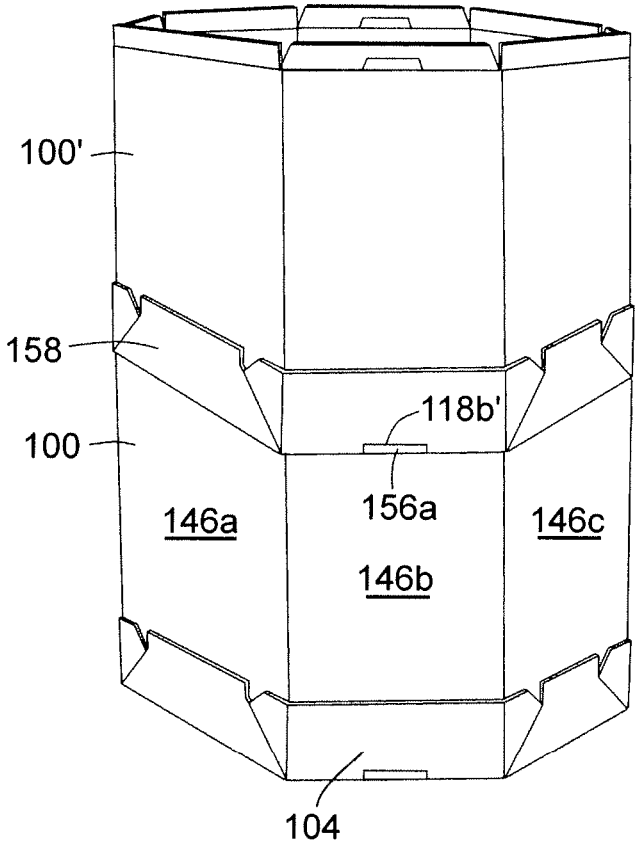
FIG. 9 shows the container assembly of FIG. 5 being stacked with another like container assembly.

FIG. 9 shows the container assembly 100 of FIG. 1 being stacked with a second, similar container assembly 100'. Prior to stacking the second container assembly 100' on top of the container assembly 100, the alternating flanges 150*a-d* and flaps 152*a-d* extending from the top ends 154 of the sides 146*a-h* of the container assembly 100 are folded along their respective fold lines 148*a-h* toward an interior portion 157 (see FIGS. 5, 7) of the container assembly 100. The stacking features 156*a-d* project upward from and are generally parallel with the side panels 146*b*, 146*d*, 146*f*, 146*h*. When the container assemblies 100, 100' are aligned and stacked as shown in FIG. 9, the stacking features 156*a-d* of the container assembly 100 extend through respective apertures 118*a'*-118*d'* in a base portion 158 of the second container assembly 100'. As a result, the stacked container assemblies 100, 100' are less likely to tip, become un-stacked, become unaligned, or the like.

According to another embodiment, the container assemblies described herein may include a reinforcing insert portion(s). The reinforcing insert portions will be described with reference to the stackable container assembly 100 of FIGS. 5, 9 because it may be desirable to strengthen the stackable container assembly 100 so that it does not collapse when supporting one or more other stackable container assemblies stacked on top of the stackable container assembly 100. However, it should be understood that reinforcing insert portions may be used with any of the container assemblies described herein. Furthermore, it is contemplated that the reinforcing insert portions may include suitable insert portions other than those shown and described herein.

Figure 10:
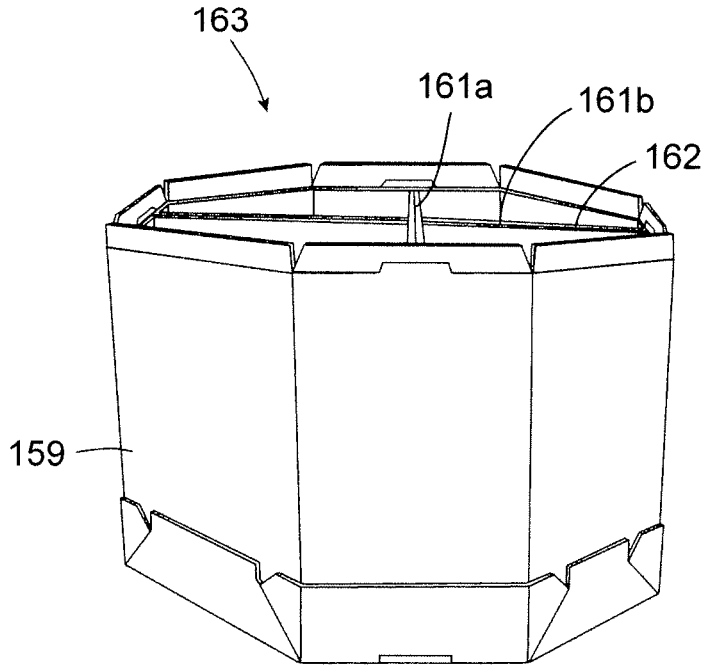
FIG. 10 is a top perspective view of a container assembly having a reinforcing insert portion according to one embodiment.

FIG. 10, for example, illustrates a top perspective view of the stackable container assembly 159 similar to the container assembly 100 of FIG. 5. The stackable container assembly 159 includes a reinforcing portion 162 including a first insert portion 161*a* and a second insert portion 161*b*. In the illustrated embodiment, the first and second insert portions 161*a,b* are made of single-wall corrugated fiberboard. The first and second insert portions 161*a,b* intersect at or near the center of the interior 163 of the container assembly 159. The first and second insert portions 161*a,b* may be generally identical to one another (e.g., in embodiments where the length of the container assembly 159 is generally the same as the width of the container assembly 159).

Figure 11:
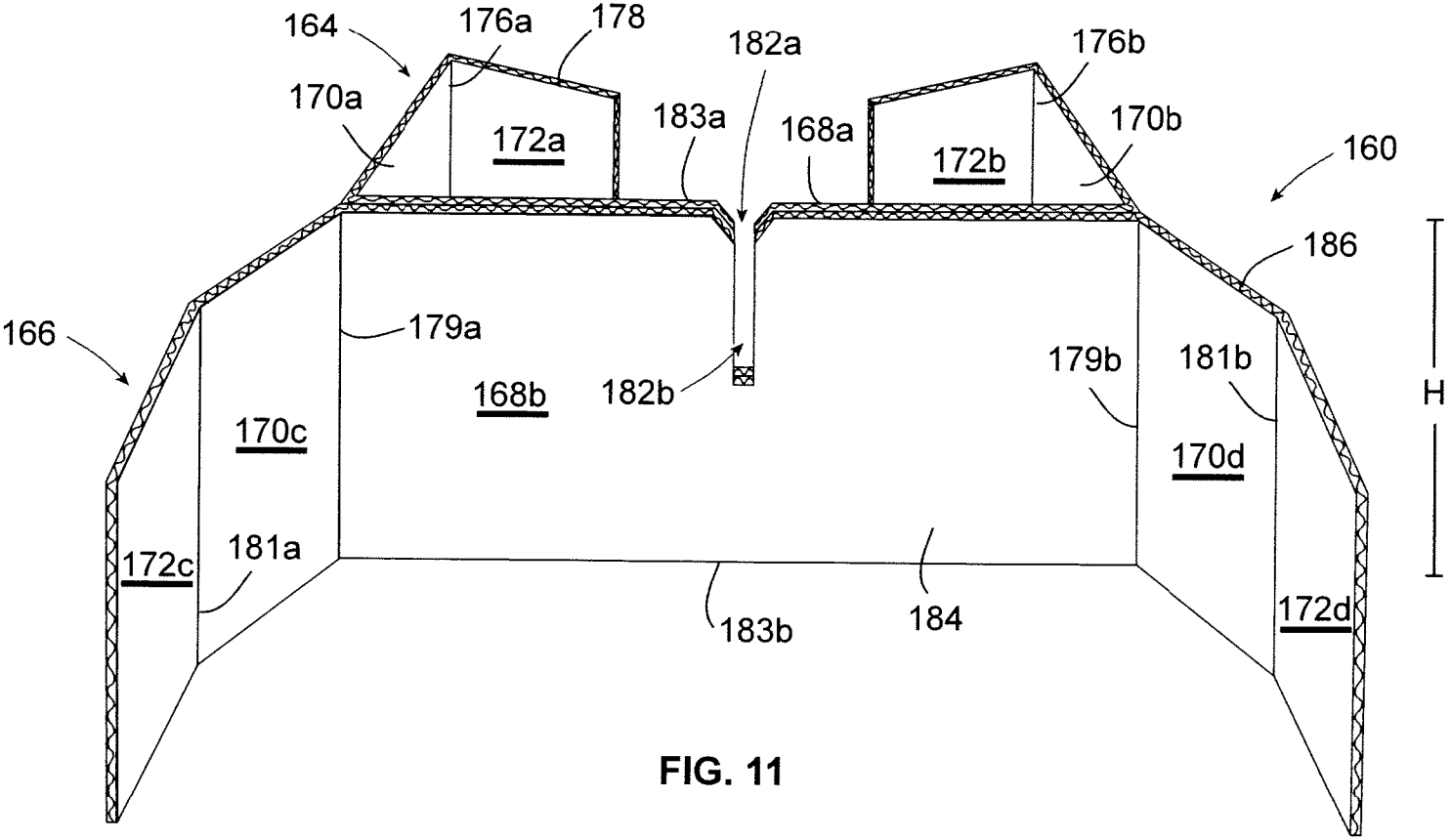
FIG. 11 is an isometric view of a portion of the reinforcing insert portion of FIG. 10.

FIG. 11 shows an insert portion 160 prior to being inserted into the container assembly 159 according to one embodiment. The insert portion 160 shown in FIG. 11 includes a first half 164 and a second half 166. The first half 164 includes a first main portion 168*a*, first and second central portions 170*a,b*, and first and second endmost portions 172*a,b*. The first main portion 168*a* is separated from the first and second central portions 170*a*, 170*b* by respective fold lines (see fold lines 174*a'*, 174*b'* of FIG. 12*a* and fold lines 174*a"* and 174*b"* of FIG. 12*b*). The first and second central portions 170*a,b* are separated from the respective first and second endmost portions 172*a,b* by respective fold lines 176*a*, 176*b*. Likewise, the second half 166 includes a second main portion 168*b*, third and fourth central portions 170*c,d*, and third and fourth endmost portions 172*c,d*. The second main portion 168*b* is separated from the third and fourth central portions 170*c*, 170*d* by respective fold lines 179*a*, 179*b*. The third and fourth central portions 170*c,d* are separated from the respective third and fourth endmost portions 172*c,d* by respective fold lines 181*a*, 181*b*.

The first and second main portions 168*a,b* further form generally aligning apertures 182*a*, 182*b*. The heights of the apertures 182*a*, 182*b* are generally about one-half the height H of the insert portion 160. It is contemplated, however, that the apertures may have other heights (e.g., greater than one-half the height H of the insert portion 160).

When the insert portion 160 is inserted into the interior 157 of the container assembly 159, the first main portion 168*a* is generally flush with the second main portion 168*b* such that the first aperture 182*a* of the first main portion 168*a* is generally flush with the second aperture 182*b* of the second main portion 168*b*. The first main portion 168*a* is coupled to the second main portion 168*b* at a first end 183*a* or a second, opposing end 183*b* by a fold line or a combination of a fold line and a cut line (see partial cut line 188, 188' of FIGS. 12*a*, 12*b*, respectively). As shown in FIG. 11, a first linerboard 184 and a corrugated material 178 may be cut along the partial cut-line 188, 188' such that the first and second main panels 168*a*, 168*b* are attached only by a second linerboard 186, thereby making it easier to fold the first insert portion 160.

Figure 12A:
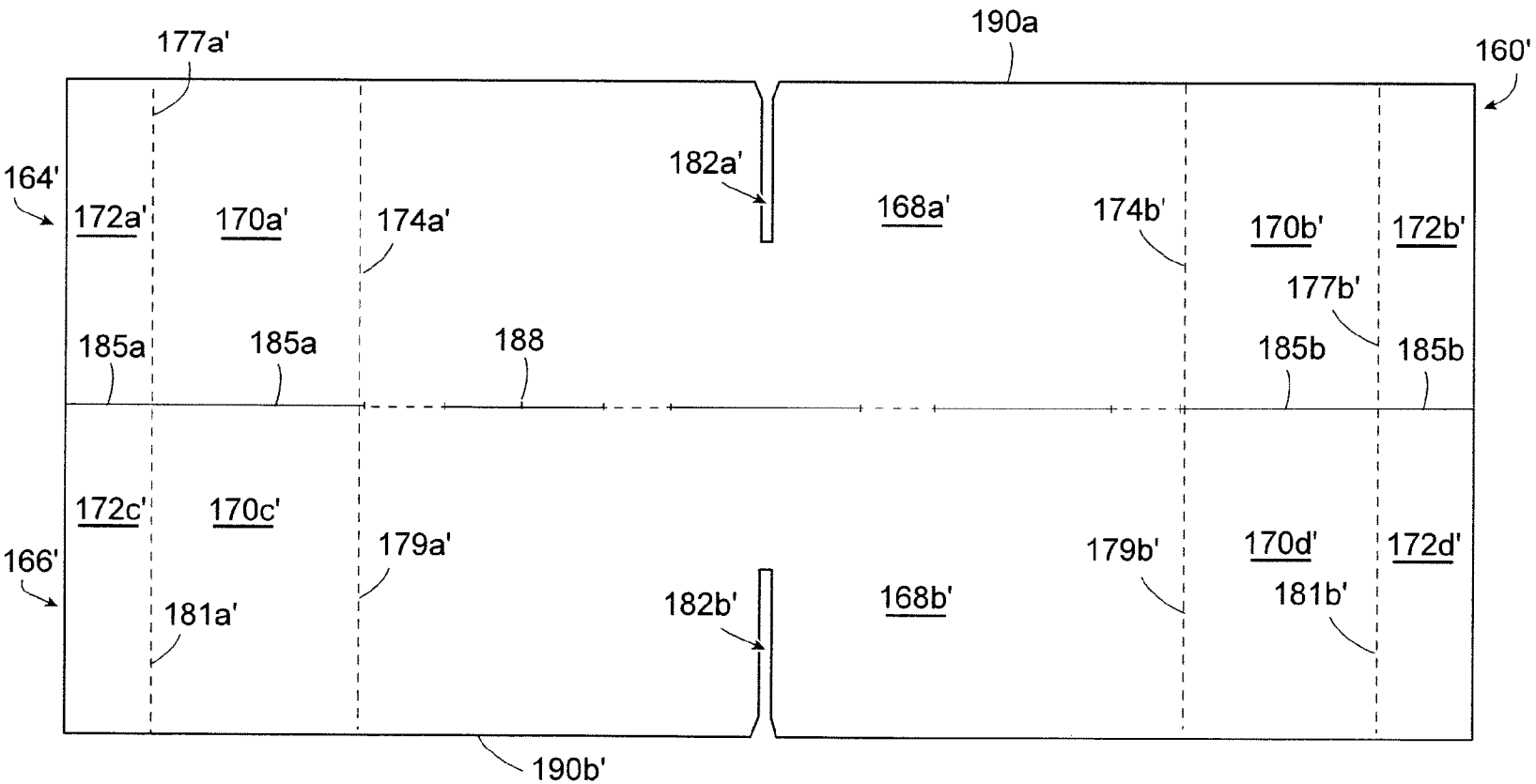
FIG. 12*a* is a plan view of an insert portion blank for forming the insert portion of FIGS. 10, 11, according to one embodiment.
Figure 12B:
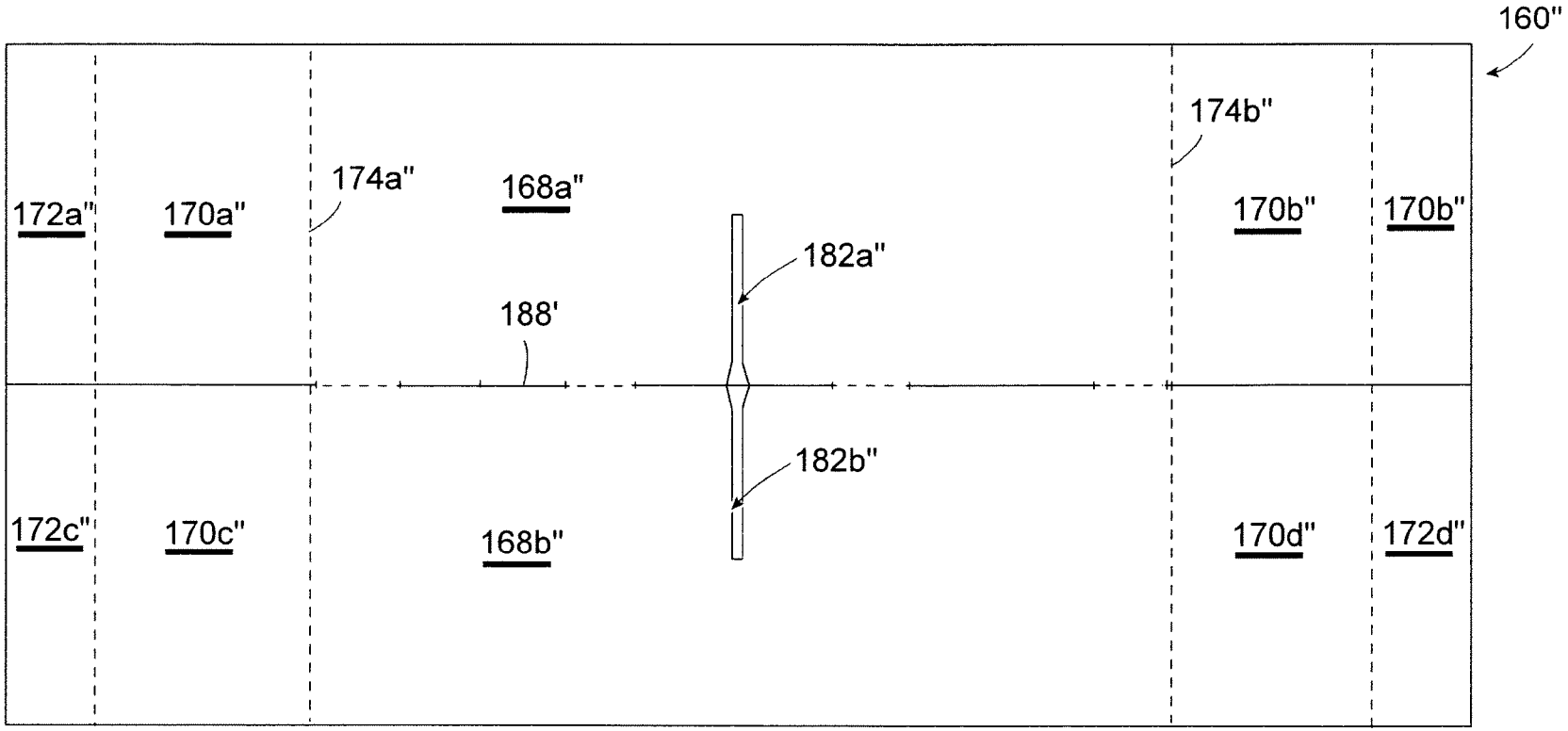
FIG. 12*b* is a plan view of an insert portion blank for forming the second insert portion of FIGS. 10, 11, according to another embodiment.

FIGS. 12*a*, 12*b* show plan views of two embodiments of an insert portion blank 160', 160" for the formation of the first insert portion 160 of FIG. 11. Referring to FIG. 12*a*, the first insert portion blank 160' includes a first half 164' (corresponding with the first half 164 of FIG. 11) and a second half 166' (corresponding with the second half 166 of FIG. 11). Each of the first and second halves 164', 166' include main panels 168*a'*, 168*b'*, central panels 170*a'*-170*d'*, and endmost panels 172*a'*-172*d'*. The main panels 168*a'*, 168*b'* are separated from the respective central panels 170*a'*-170*d'* by respective fold lines 174*a'*, 174*b'*, 179*a'*, 179*b'*. The central panels 170*a'*-170*d'* are separated from the respective endmost panels 172*a'*-172*d'* by respective fold lines 177*a'*, 177*b'*, 181*a'*, 181*b'*. In the embodiment of FIG. 12*a*, the main panels 168*a'*, 168*b'* are separated from one another by a partial cut-line 188. The central and endmost panels 170*a'*, 170*b'*, 172*a'*, 172*b'* of the first half 164' are separated from corresponding central and endmost panels 170*c'*, 170*d'*, 172*c'*, 172*d'* of the second half 166' by cut lines 185*a,b*.

As described above with respect to FIG. 11, the first and second main portions 168*a'*, 168*b'* further include apertures 182*a'*, 182*b'*. In the embodiment of FIG. 12*a*, the apertures 182*a'*, 182*b'* are positioned at ends 190*a*, 190*b* of the insert portion 160' generally opposite the partial cut line 188.

Referring now to FIG. 12*b*, an insert portion blank 160" similar to the insert portion blank 160' of FIG. 12*a* is shown. For example, the insert portion blank 160" of FIG. 12*b* includes first and second main portions 168*a"*, 168*b"*, central portions 170*a"*-170*d"*, and endmost portions 172*a"*-172*d"*. However, the insert portion blank 160" differs from the insert portion blank 160' of FIG. 12*a* in that the insert portion blank 160" of FIG. 12*b* includes apertures 182*a*", 182*b*" positioned near the center of the insert portion blank 160" (i.e., on the same end of the first and second main portions 182*a*", 182*b*" as a partial cut line 188' coupling the first main portion 168*a*" to the second main portion 168*b*".

Referring back to FIG. 10, it is contemplated that the first and second insert portions 161*a,b* may both be formed from the insert portion blank 160' of FIG. 12*a*. Alternatively, both the first and second insert portions 161*a,b* may be formed from the insert portion blank 160" of FIG. 12*b*. In yet another embodiment, one of the first and second insert portions 161*a,b* of FIG. 10 may be formed from the insert portion blank 160' of FIG. 12*a* and the other of the first and second insert portions 161*a,b* of FIG. 10 may be formed from the insert portion blank 160" of FIG. 12*b*.

According to one embodiment, to form the reinforcing portion 162 of FIG. 10, the insert portion 161*a* is placed into the interior of a container assembly (e.g., the container assembly 159 of FIG. 10) such that the apertures 182*a*, 182*b* are positioned near a top 183 of the container assembly 159. An inverted second insert portion 161*b* is then placed generally perpendicular to the first insert portion 161*a* such that the apertures 182*a*, 182*b* of the first insert portion 161*a* are generally adjacent to the apertures of the second insert portion 161*b*. The resulting reinforcing portion 162 divides the interior of the container assembly 159 into four compartments.

The tube portion (e.g., tube portion 12 of FIG. 1) and the base portion (e.g., base portion 14 of FIG. 1) of the container assemblies described herein may be formed from a single-wall or a double-wall corrugated fiberboard. Alternatively, one of the tube portion 12, and the base portion 14 may be formed from a single-wall corrugated fiberboard and the other of the tube portion and the base portion 14 may be formed from a double-wall corrugated fiberboard. In one embodiment, for example, the tube portion 12 is single-wall corrugated fiberboard and the base portion 14 is double-wall corrugated fiberboard. This may be desirable since the majority of the weight of the contents of the container assembly (e.g., container assembly 10 of FIG. 1) is supported by the base portion 14. Because the tube portion 12 may be formed from a single-wall corrugated fiberboard without significantly decreasing the strength of the container assembly 10, the cost of manufacturing such a container assembly may be substantially reduced.

The container assemblies of the embodiments described herein may be assembled using any suitable means. For example, it is contemplated that assembly of the container assemblies of the embodiments described herein may be fully (or nearly fully) automated. In one embodiment, for example, a tube portion (e.g., tube portion 12 of FIG. 3) having endmost side panels 46*h,i* already attached may be brought in through extended glue heads and popped open. An operator may then load the tube portion 12 and the base portion 14 into a magazine that erects the tube portion 12 and laminates the base portion 14 to the tube portion 12 to produce a fully automated container assembly.

In yet another embodiment, the process of forming a container assembly of the embodiments of the present invention is partially automated. In this embodiment, the tube portion 12 (e.g., tube portion 12 of FIG. 1) may be manually erected. A machine may apply adhesive to the flaps 20*a-h* of the base portion 14 and/or a bottom region of the tube portion 12. The machine may then fold the flaps 20*a-h* of the base portion 15 upward toward the tube portion 12, attaching the flaps 20*a-h* to the bottom region of the tube portion 12.

In yet another embodiment, the container assemblies of the embodiments described herein are manually assembled. In this embodiment, the tube portion (e.g., tube portion 12 of FIG. 1) is assembled such that the endmost side panels 46*h,i* of the tube portion 12 are adhered to one another. A fixture insert may then be inserted into the tube portion 12 to maintain the shape of the tube portion 12. The tube portion 12 is then set on top of the base blank 14'. One or more operators may then apply adhesive on the flaps 20*a-h* of the base blank 14' and/or on a bottom region of the tube portion 14 and fold the flaps 20*a-h* such that the flaps 20*a-h* attach to the tube portion 12.

Figure 13:
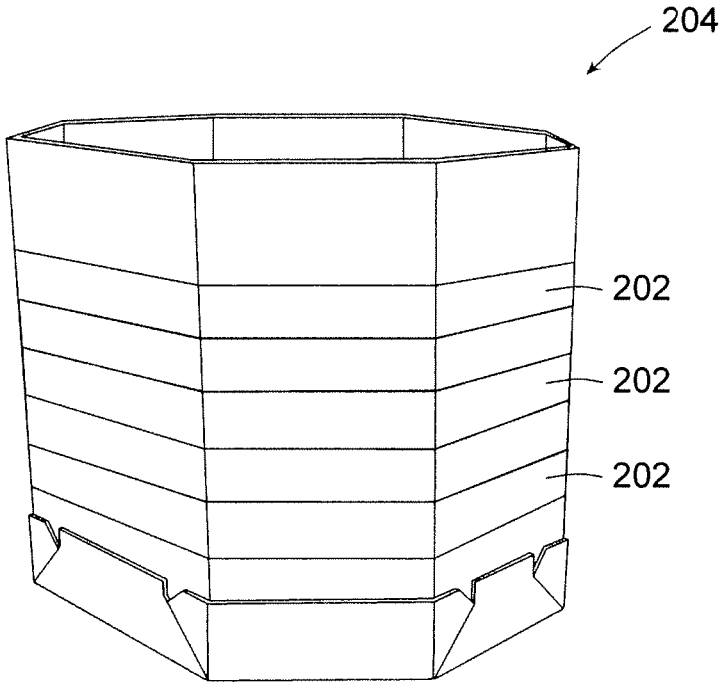
FIG. 13 is an isometric view of a container assembly according to yet another embodiment of the present invention.

Although not required or necessary, any of the container assemblies of the embodiments of the present invention may include one or more external reinforcement straps 202, as shown in a container assembly 204 of FIG. 13. The reinforcement strap 202 may be a single, generally seamless reinforcement strap continuously wound around a periphery of the container assembly 204. Non-limiting examples of materials that may be utilized for the reinforcement strap 202 include reinforced packaging tape, adhesive tape, polymeric film, and stretch polymeric string. Although in the embodiment of FIG. 13, three reinforcing straps 202 are shown, it is contemplated that any suitable number of reinforcing straps may be used.

Because the enhanced bottom corners and vertical scores of the container assemblies described herein provide enhanced structural integrity to the container assemblies, the use of internal and external strapping may be reduced or eliminated. This is beneficial from both a manufacturing, cost, and environmental standpoints.

According to alternative embodiment A, a container assembly comprising a tube portion including a plurality of sides and a base portion including a bottom panel and a plurality of flaps extending from the bottom panel, the plurality of flaps overlapping a portion of the plurality of sides.

According to alternative embodiment B, the container assembly of alternative embodiment A, wherein the number of the plurality of sides is the same as the number of the plurality of flaps.

According to alternative embodiment C, the container assembly of alternative embodiment B, wherein the amount is eight.

According to alternative embodiment D, the container assembly of alternative embodiment A, wherein the container assembly includes corrugated fiberboard.

According to alternative embodiment E, the container assembly of alternative embodiment D, wherein the tube portion includes single-wall corrugated fiberboard, and the base portion includes double-wall corrugated fiberboard.

According to alternative embodiment F, the container assembly of alternative embodiment A, wherein the plurality of flaps is adhered to a bottom region of the plurality of sides.

According to alternative embodiment G, the container assembly of alternative embodiment F, wherein at least one of the flaps includes a main portion, a first tab, and a second tab, the first and second tabs being separated from the main portion by first and second fold lines, the first and second fold lines generally overlapping opposing ends at least one of the plurality of sides.

According to alternative embodiment H, the container assembly of alternative embodiment A, wherein the bottom panel includes a collapsible feature including a plurality of perforations, cut-lines, or a combination thereof.

According to alternative embodiment I, the container assembly of alternative embodiment A, wherein the bottom panel is a continuous, uninterrupted panel.

According to alternative process J, a method of forming a container assembly comprising the acts of adhering a first end of a tube portion to a second, opposing end of the tube portion, the tube portion including a plurality of sides and providing a base portion having a bottom panel, the bottom panel having a plurality of flaps extending therefrom placing the tube portion over the base portion folding the plurality of flaps along fold lines, the fold lines separating the plurality of flaps from the bottom panel and attaching each of the plurality of flaps to a respective one of the plurality of sides of the tube portion.

According to alternative process K, the method of alternative process J, further comprising the act of inserting a reinforcing portion into an interior of the container assembly, the reinforcing portion dividing the interior of the container assembly into a plurality of compartments.

According to alternative process L, the method of alternative process J, wherein at least one of the acts of folding the plurality of flaps and attaching the plurality of flaps is at least partially automated.

According to alternative process M, the method of alternative process J, wherein the tube portion is comprised of single-wall corrugated fiberboard, and the base portion is comprised of double-wall corrugated fiberboard.

According to alternative embodiment N, a container assembly comprising a tube portion including a plurality of sides of a base portion including a bottom panel and a plurality of flaps extending from the bottom panel, the plurality of flaps overlapping a bottom region of the plurality of sides and at least one insert portion, the at least one insert portion dividing an interior of the container into a plurality of compartments.

According to alternative embodiment O, the container assembly of alternative embodiment N, wherein the number of the plurality of sides is the same as the number of the plurality of flaps.

According to alternative embodiment P, the container assembly of alternative embodiment N, wherein the container assembly includes corrugated fiberboard.

According to alternative embodiment Q, the container assembly of alternative embodiment N, wherein the bottom panel includes a collapsible feature including a plurality of perforations, cut-lines, or a combination thereof.

According to alternative embodiment R, the container assembly of alternative embodiment N, wherein the bottom panel is a continuous, uninterrupted panel.

According to alternative embodiment S, the container assembly of alternative embodiment N, wherein the at least one insert portion includes a first insert portion and a second insert portion, the first and second insert portions intersecting to divide the interior of the container assembly into four compartments.

According to alternative embodiment T, a stackable container assembly comprising of a tube portion including a plurality of sides, each of the plurality of sides having a first end and a second, opposing end, at least one of the plurality of sides having a stacking feature extending from at least one of the first ends, the stacking feature being generally parallel to the at least one of the plurality of sides and a base portion including a bottom panel and a plurality of flaps extending therefrom, the plurality of flaps being separated from the bottom panel by a plurality of fold lines, the base portion further including at least one aperture positioned along at least one of the plurality of fold lines, the plurality of flaps overlapping the second, opposing ends of the plurality of sides, wherein the container assembly is configured to be stacked on a second, similar container assembly by engaging the stacking feature of the container assembly with an aperture on a base portion of the second container assembly to prevent or inhibit lateral movement of the container assembly relative to the second container assembly.

According to alternative embodiment U, the container assembly of alternative embodiment T, wherein the tube portion further includes a plurality of flanges extending from the first ends of the plurality of sides, the stacking feature, or a combination thereof.

According to alternative embodiment V, the container assembly of alternative embodiment U, wherein the plurality of flanges is separated from the first ends of the plurality of sides by a plurality of fold lines, and wherein the plurality of flanges is separated from the stacking feature by a cut-line.

According to alternative embodiment W, the container assembly of alternative embodiment T, wherein the at least one stacking feature is a plurality of stacking features positioned on alternating sides of the tube portion, and wherein the at least one aperture is a plurality of apertures positioned on alternating fold lines of the base portion.

According to alternative embodiment X, the container assembly of alternative embodiment T, further comprising a reinforcing insert portion, the reinforcing insert portion separating an interior of the container assembly into more than one compartment.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A container assembly comprising:

a tube portion including a plurality of sides; and a base portion including a bottom panel and a plurality of flaps extending from the bottom panel, the plurality of flaps overlapping a portion of the plurality of sides, the bottom panel including a collapsible feature, the collapsible feature including at least one tear-out panel formed by a plurality of perforations, cut-lines, or a combination thereof.

2. The container assembly of claim 1, wherein the number of the plurality of sides is the same as the number of the plurality of flaps.

3. The container assembly of claim 2, wherein the amount is eight.

4. The container assembly of claim 1, wherein the container assembly includes corrugated fiberboard.

5. The container assembly of claim 4, wherein the tube portion includes single-wall corrugated fiberboard, and the base portion includes double-wall corrugated fiberboard.

6. The container assembly of claim 1, wherein the plurality of flaps is adhered to a bottom region of the plurality of sides.

7. The container assembly of claim 6, wherein at least one of the flaps includes a main portion, a first tab, and a second tab, the first and second tabs being separated from the main portion by first and second fold lines, the first and second fold lines generally overlapping opposing ends at least one of the plurality of sides.

8. The container assembly of claim 1, wherein each of the plurality of sides has a first end and a second, opposing end, at least one of the plurality of sides having a stacking feature extending from at least one of the first ends, the plurality of flaps of the base portion being separated from the bottom panel by a plurality of fold lines, the base portion further including at least one aperture positioned along at least one of the plurality of fold lines generally opposite the stacking feature, the container assembly being configured to be stacked on a second, similar container assembly by engaging the stacking feature of the container assembly with an aperture on a base portion of the second container assembly to prevent or inhibit lateral movement of the container assembly relative to the second container assembly.

9. The container assembly of claim 1, wherein the collapsible feature further includes two perforated lines intersecting at or near a center of the bottom panel.

10. The container assembly of claim 9, further comprising a cut-out portion at or near a point on the bottom panel where the two perforated lines intersect.

11. The container assembly of claim 1, wherein the at least one tear-out panel is a plurality of tear-out panels.

12. The container assembly of claim 11, wherein the plurality of tear-out panels is positioned at or near respective sides of the bottom panel.

13. The container assembly of claim 12, wherein the plurality of tear-out panels is bound by a pair of converging perforated lines extending from points near the respective side of the bottom panel and terminating in a respective pair of cut-out lines.

14. A container assembly comprising:

a tube portion including a plurality of sides;

a base portion including a bottom panel and a plurality of flaps extending from the bottom panel, the plurality of flaps overlapping a bottom region of the plurality of sides, the bottom panel including a collapsible feature, the collapsible feature including at least one tear-out panel formed by a plurality of perforations, cut-lines, or a combination thereof; and at least one insert portion, the at least one insert portion dividing an interior of the container into a plurality of compartments.

15. The container assembly of claim 14, wherein the number of the plurality of sides is the same as the number of the plurality of flaps.

16. The container assembly of claim 14, wherein the container assembly includes corrugated fiberboard.

17. The container assembly of claim 14, wherein the at least one insert portion includes a first insert portion and a second insert portion, the first and second insert portions intersecting to divide the interior of the container assembly into four compartments.

18. The container assembly of claim 14, wherein the collapsible feature further includes two perforated lines intersecting at or near a center of the bottom panel.

19. The container assembly of claim 18, further comprising a cut-out portion at or near a point on the bottom panel where the two perforated lines intersect.

20. The container assembly of claim 14, wherein the at least one tear-out panel is a plurality of tear-out panels.

21. The container assembly of claim 20, wherein the plurality of tear-out panels is positioned at or near respective sides of the bottom panel.

22. The container assembly of claim 21, wherein the plurality of tear-out panels is bound by a pair of converging perforated lines extending from points near the respective side of the bottom panel and terminating in a respective pair of cut-out lines.

* * * * *